US005859620A

United States Patent [19]

Skinner et al.

[11] Patent Number: 5,859,620

[45] Date of Patent: Jan. 12, 1999

[54] MULTIBAND FEEDHORN MOUNT ASSEMBLY FOR GROUND SATELLITE RECEIVING ANTENNA

[75] Inventors: Thomas J. Skinner, Littleton; Keith E. Hannon, Larkspur, both of Colo.

[73] Assignee: Hughes Electronics Corporation, El Segundo, Calif.

[21] Appl. No.: 757,313

[22] Filed: Nov. 27, 1996

[51] Int. Cl.[6] ..... H01Q 1/12

[52] U.S. Cl. ..... 343/880; 343/761; 343/779; 343/892

[58] Field of Search ..... 343/779, 880, 343/882, 781 P, 781 R, 774, 776, 786, 765, 892, 893

[56] References Cited

U.S. PATENT DOCUMENTS

| | | | |
|---|---|---|---|
| 3,164,835 | 1/1965 | Alsberg | 343/779 |
| 3,633,208 | 1/1972 | Ajioka | 343/786 |
| 3,792,474 | 2/1974 | Meek et al. | 343/761 |
| 4,185,287 | 1/1980 | Hubing et al. | 343/761 |
| 4,792,813 | 12/1988 | Rosen | 343/779 |
| 4,819,006 | 4/1989 | Whitesides et al. | 343/880 |

*Primary Examiner*—Hoanganh T. Le
*Assistant Examiner*—Tho Phan
*Attorney, Agent, or Firm*—Michael W. Sales; John A. Crook

[57] ABSTRACT

A low cost, highly efficient multiband feedhorn mount assembly for co-locating first and second feedhorns on a ground satellite receiving antenna comprises a first mounting bracket adapted to be secured to an antenna bridge for adjustably supporting the first feedhorn. A second mounting bracket carrying the second feedhorn is adjustably attached to the first mounting bracket such that the first and second feedhorns, when attached respectively to the first and second mounting brackets, may be individually oriented relative to the antenna reflector. Co-located transmissions in different frequency bands from one or more satellites may thus be received without the need for a costly hybrid multiband feedhorn. Methods for installing the assembly are disclosed.

20 Claims, 4 Drawing Sheets

MULTIBAND FEEDHORN MOUNT ASSEMBLY FOR GROUND SATELLITE RECEIVING ANTENNA

FIELD OF THE INVENTION

This invention relates to a feedhorn mount assembly for a ground satellite receiving antenna, and particularly to a multiband feedhorn mount assembly for receiving transmissions in different frequency bands from co-located satellites or from a hybrid satellites transmitting in more than one frequency band.

BACKGROUND OF THE INVENTION

In the early days of DBS (direct broadcast satellite) communications, satellite transponders were placed in widely spaced geosynchronous orbits, the earliest satellites transmitting in the "C-band" RF frequencies from 3.7 GHz to 4.2 GHz. Satellites launched more recently transmit either in the C-band or in the higher frequency "Ku" band from 11.7 GHz to 12.2 GHz.

Ground satellite receiving antennas have been constructed to simultaneously receive signals transmitted by a number of satellites in various frequency bands, including the C-band and Ku-band. One such ground satellite receiving antenna manufactured by Comsat/RSI (herein the "Torus" antenna) has a large toroidal reflector, of circular cross-section in longitude (azimuth) and of parabolic cross-section in elevation. It observes a seventy-degree sweep of the sky above the equator, and may receive transmissions from a multiplicity (e.g., more than thirty) of satellites in frequency bands including the C-band and the Ku-band.

The Torus antenna has an arcuate "bridge", offset from the central axis of the reflector by approximately 26 degrees, which supports a number of "feedhorns" (or simply "feeds") at locations along the bridge corresponding to the focal points of transmissions from the various satellites. The feedhorns detect and process the received satellite transmissions, as follows.

The RF energy from a particular satellite is collected by the antenna reflector and is focused to a narrow, approximately elliptical, zone of intense RF energy at the location of the feedhorn. In known systems, to maximize the strength of the signal received from a particular satellite, the feedhorn is first positioned along the bridge at a location indicated by a computer program provided by the antenna manufacturer. The angular elevation of the feedhorn is adjusted for peak signal strength, and its lateral position along the bridge is then fine-tuned. Finally, the angular elevation of the feedhorn is adjusted to peak the received signal.

At the feedhorn the focused RF signal energy from the selected satellite is collected and further focused by a conically shaped collector, detected by an RF probe, and amplified and block downconverted in an "LNB" (low-noise block converter).

Within the past few years, multiple satellites transmitting in different frequency bands have been placed in closely adjacent geosynchronous orbits. For example, two such "co-located" satellites, the "Galaxy 6" and the "SBS-6" satellites, are separated by only 0.05 degrees of longitude. The Galaxy 6 satellite is located at 74 degrees west longitude, transmitting in the C band, and the SBS-6 satellite is located at 74.05 degrees west longitude, transmitting in the Ku band.

Very recently "hybrid" or "double payload" satellites are being placed in orbit which broadcast signals in both the C band and the Ku band. Co-located and hybrid satellites effectively transmit signals from a common sky location. As standard receiving feedhorns are adapted to receive transmissions only in a single frequency band, the transmission of co-located signals creates a problem at the ground satellite receiving antenna.

Multiband feedhorns simultaneously receiving signals in plural frequency bands are known in the art. For example, see U.S. Pat. Nos. 4,910,527; 4,740,795; and 4,785,306. Multiband feedhorns are commercially available, typically comprising a single collector which collects linearly and orthogonally polarized co-located RF signals in two frequency bands. The collected multiband signals are internally separated by frequency band, and individually detected, amplified and downconverted.

Such multiband feedhorns are costly—typically tens of thousands of dollars per feedhorn—due to the different focal points and other varying characteristics of the signals in the different frequency bands.

It is desired, therefore, to provide a device which enables standard feedhorns for the C-band and Ku-band, e.g., to be used to receive signals from hybrid or co-located satellites. It is further desirable to accommodate these feedhorns utilizing to a large degree the existing mount hardwork without costly modification, yet provide a near-optimized, flexibly adjustable and low-cost multiband feedhorn mount assembly.

SUMMARY OF THE INVENTION

In accordance with the present invention, a multiband feedhorn mount assembly is provided which is capable of receiving co-located signals being transmitted in a plurality of different frequency bands from one or more satellites.

An adapter bracket is provided for incorporation with known single feedhorn mounting brackets. The adapter bracket includes two plate-like side legs and a base plate. The base plate preferably includes an extended platform having standard mounting slots, holes or other accommodations for receiving standard feedhorn (e.g., Ku-band) mounting brackets. The side legs are adapted to pivotally cooperate with portions of the standard single feedhorn bracket assembly, and include both a pivot and an angular securing mechanism for maintaining the adapter bracket (and particularly the base plate) at a selected angle relative to the standard mounting bracket supporting a second (e.g., C-band) feedhorn.

Standard feedhorn bracket assemblies are designed to accommodate the length of the feedhorn intended to be mounted thereon. For example, a C-band feedhorn may be approximately 20–24 inches in length or more, and includes an elongated receiving horn extending forwardly of the waveguides and LNBs. To position the input aperture of the feedhorn at the intended focal point of RF energy converged by the antenna reflector, the bracket assembly has a vertical main support member displaced suitably away from the reflector focal point to correspond with the center (ideally the center of gravity) of the assembled feedhorn. In contrast, a typical Ku-band feedhorn is smaller, typically 10–12 inches in length. Accordingly, a standard Ku-band feedhorn mounting bracket assembly includes a vertical main support member located forwardly on the bracket assembly near the antenna reflector focal point to position the smaller feedhorn collector input aperture at the appropriate location.

A dual feedhorn mount assembly must ideally accommodate the different requirements of feedhorns of different size (particularly length). In accordance with aspects of the present invention, a device and method are provided for modifying a standard mount bracket assembly (or providing new bracket assembly having similar characteristics) which can accommodate the differing requirements of, e.g., C-band and Ku-band feedhorns in a flexible, easily configured arrangement that can be optimized for simultaneous reception of co-located signals. In particular, a bracket assembly adapted generally for supporting a smaller (e.g., Ku-band) feedhorn may be used. Such a bracket will typically have a main vertical support member located farther forwardly than is desirable for a larger (e.g., C-band) feedhorn.

In a known bracket, a shelf member is mounted to the front of the upright main support member, extending toward the reflector of the antenna. This shelf member may be removed, and shifted to a new location away from the focal point. Standard shelf members include mounting holes at the front and back, where the back holes receive a bolt forming a pivot on the main support member, and the front holes (located toward the reflector) receive a bolt securing an angular adjustment strut. By reversing these relative functions (i.e., by utilizing the forward holes to receive the pivot bolt securing the shelf to the upright, and the rearward holes to secure the angular adjustment strut), the standard shelf member is moved away from the reflector to a location which can more easily accommodate the preferably centered mounting bracket of a larger (e.g., C-band) feedhorn.

An adapter bracket may then be provided for mounting a second feedhorn in a "piggyback" arrangement above the first feedhorn and secured to the modified standard bracket assembly. In a preferred embodiment, the plate-like side legs of the bracket include apertures aligned with the shelf member front and back holes described above. The same bolts which are used to secure the shelf member in the standard bracket assembly may be used (or substituted for by longer bolts) to simultaneously join the previously described shelf member and the adapter bracket. A first pair of apertures in the side legs forms a pivot on the said bolt, while a second pair of arcuate slots provides for angular adjustment or tilt of the adapter bracket relative to the standard, or modified standard, bracket. The side legs provide support for a base plate, which preferably includes an extended platform in the direction of the antenna reflector.

In the preferred embodiment, this extended platform supports the input aperture of the Ku-band feedhorn at substantially the same distance from the reflector as the original Ku-band bracket shelf member prior to its reconfiguration, as discussed below.

In other words, the standard bracket assembly is reconfigured to provide a first support location located relatively away from the focal point for receiving a larger feedhorn having an extended collector, and a second support location relatively closer to the focal point for receiving a smaller feedhorn. As a result, the input apertures of the respective feedhorns are maintained at substantially the desired focal point of the antenna, one above the other, where both are flexibly adjustable in both vertical and longitudinal angles to maximize respective signal reception of the standard feedhorns.

DESCRIPTION OF THE PREFERRED EMBODIMENTS

As used herein, the term "co-located signals" or "co-located transmissions" shall mean signals or transmissions either from separate but closely spaced satellites, or from a single satellite.

The figures illustrated a preferred embodiment of the invention. In general terms, the invention is intended for use in a ground satellite receiving antenna for receiving co-located transmissions in a plurality of different frequency bands from one or more satellites, and comprises a low-cost, highly efficient assembly in which a like plurality of individually orientable feedhorns are coupled in a piggy-backed arrangement. Each feedhorn receives transmissions in a different one of the plurality of frequency bands.

Figure 1:
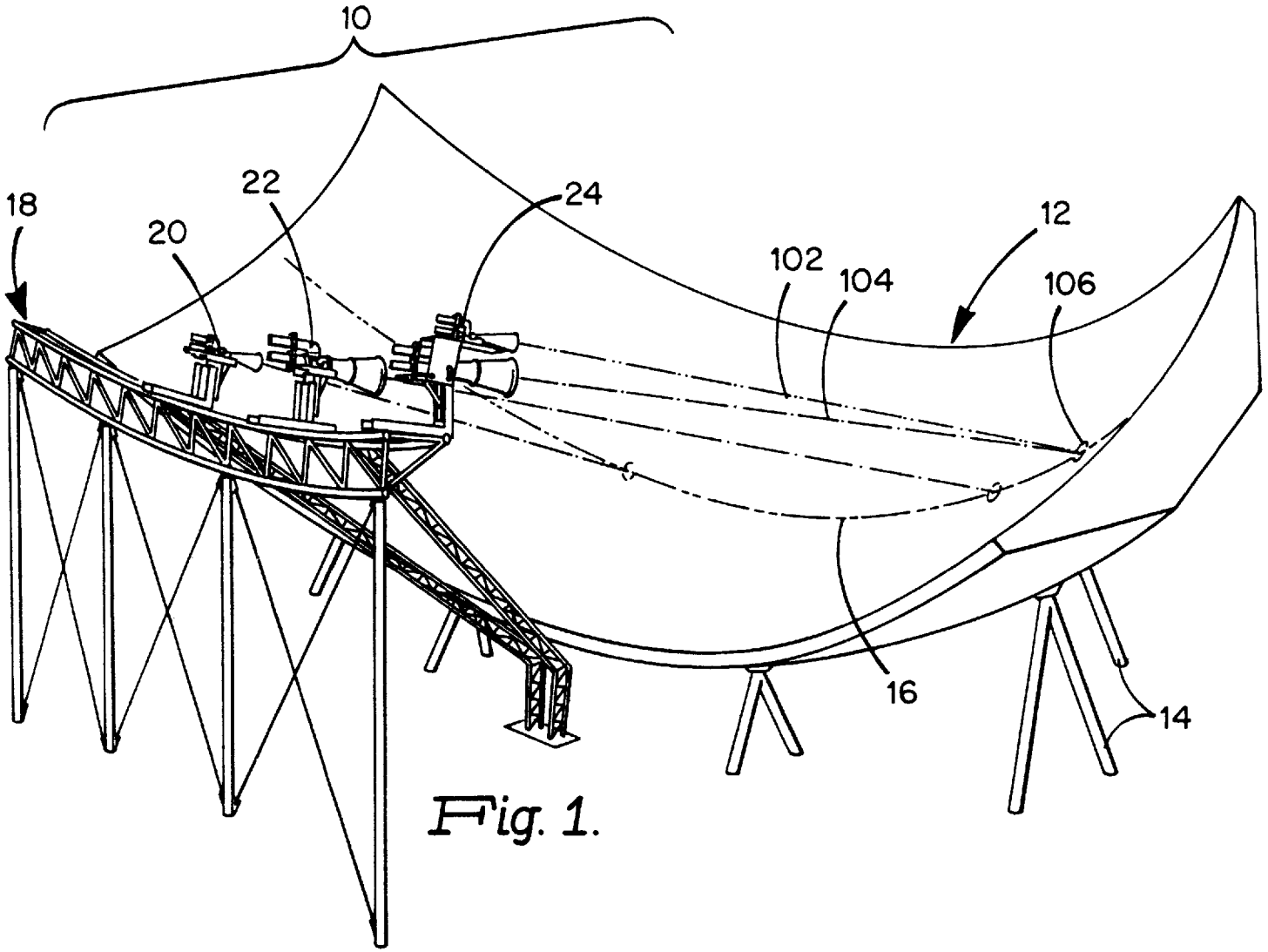
FIG. 1 is a schematic view of a ground satellite receiving antenna embodying the present invention.

More specifically, FIG. 1 depicts a known ground satellite receiving antenna 10 including a torodial reflector 12. The reflector 12 is circular in cross-section in a horizontal (longitude or azimuth) plane and parabolic in cross-section in an elevational plane. The illustrated reflector 12 is of the off-set parabolic type wherein the satellite transmissions are received off axis. The reflector is supported by a plurality of braces 14.

The antenna 10 includes an arcuate bridge 18 which is displaced from the central axis of the reflector 12. The bridge 18 supports a feedhorn at each of a number of locations therealong corresponding to the focal points the various satellites transmissions. By way of example, the invention may be employed with a Comsat "Torus" antenna having a reflector of the off-set parabolic type, with the off-set being approximately 26 degrees. The "Torus" antenna receives signals from more than 30 satellites longitudinally spaced in geosynchronous orbits above the equator. By way of example only, FIG. 1 shows three feedhorns—a typical Ku-band feedhorn 20 mount assembly, a typical C-band feedhorn 22 mount assembly, and a multiband feedhorn mount assembly 24 constructed in accordance with an aspect of the present invention.

Figures 1A, 2:
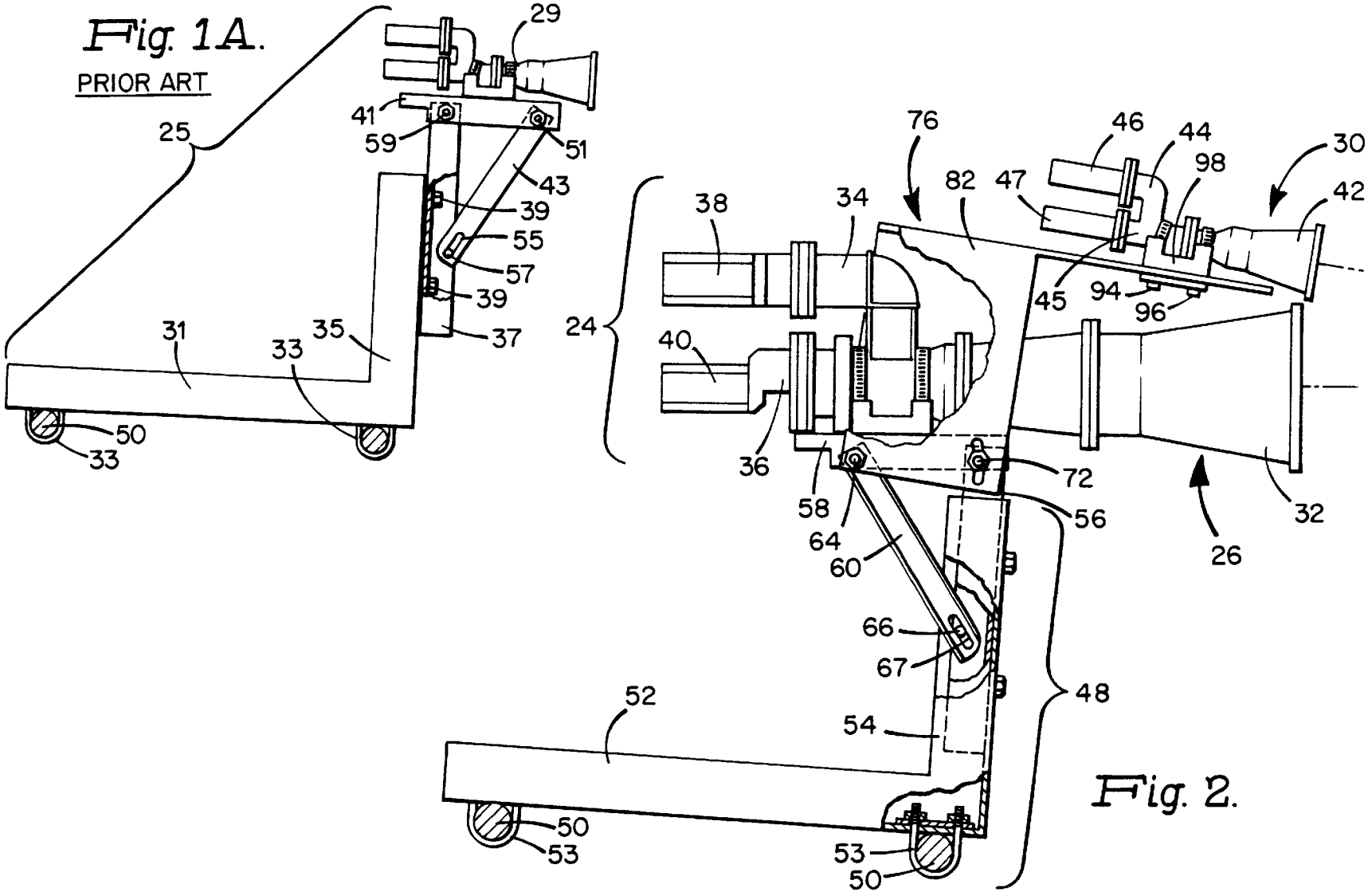
Fig. 1A. PRIOR ART
FIG. 1A is a view of a prior art Ku-band feedhorn mount assembly.
FIG. 2 is a side elevation view of a multiband feedhorn mount assembly according to the present invention.

Referring particularly to FIG. 2, the multiband feedhorn mount assembly 24 supports a C-band feedhorn 26 and a Ku-band feedhorn 30. The C-band feedhorn 26 comprises a collector 32 which collects RF energy focused in the region of the feedhorn 26 by the antenna reflector 12. The collector 32 brings the converged RF energy to a final focus at the back of the collector 32.

The C-band signals being received by the feedhorn 30 comprise a pair of linearly polarized signals of orthogonal relative orientation. The orthogonally polarized signals are separated by a polarization discriminator (not shown) and directed into two waveguide sections 34, 36. The separated signals are individually detected, amplified and downconverted by LNBs (low noise block converters) 38, 40.

The Ku-band signals are also of the orthogonally linearly polarized format. Like the C-band feedhorn 26, the Ku-band feedhorn 30 comprises a collector 42, waveguide sections 44, 45 and LNBs 46, 47, and functions in the same way as the C-band feedhorn 26.

In accordance with an aspect of the present invention, a multiband feedhorn mount assembly is provided for receiving co-located signals being transmitted in a plurality of different frequency bands from one or more satellites. As will be understood from the following description, the mount assembly of the present invention is simple and of low cost construction, is quick and easy to install, and highly efficient.

As shown with particular clarity in FIGS. 2–5, the multiband feedhorn mount assembly of the present invention comprises a first mounting bracket 48 secured, for example, to bridge elements 50 or other supports for adjustably supporting the C-band feedhorn 26.

The first mounting bracket 48 comprises an L-shaped base 52 anchored to bridge elements 50 by U-bolts 53 which carries within a channel-shaped vertical leg 54 a vertical slide channel 56. Pivotally connected to the top of the vertical slide channel 56 is a shelf member 58 which is braced by an adjustable support strut 60.

The vertical slide channel 56 has a series of bolts, two of which are shown at 62, which pass through vertical slots (not shown) in the vertical leg 54 of the base 52, and which enable the vertical slide channel 56 and the shelf member 58 carried thereby to be varied in vertical elevation.

The strut 60 is pivotally attached at one end to the shelf member 58 by a bolt 64 and at its other end has a slot 60 which slides on a bolt 66 passing through side walls of the vertical slide channel 56. A pair of spacers 68, 70 center the strut 60 on the bolt 66.

The shelf member 58 is pivotally attached to the upper end of the vertical slide channel 56 by a bolt 72 which passes through the side walls of the vertical slide channel 56. The bolt 72 defines a pivot axis 74.

As will be discussed, the bracket assembly 48 is a reconfiguration of a standard Ku-band bracket assembly which makes possible the multiband feedhorn mount assembly according to the present invention. The novel reconfiguration may be best understood by reference to FIG. 1A which is a simplified view of a typical (prior art) Ku-band feedhorn mount assembly 20. The known Ku-band mount assembly is illustrated in FIG. 1A as comprising a bracket assembly 25 for adjustably supporting a Ku-band feedhorn 29. The bracket assembly 25 includes an L-shaped base 31 anchored to bridge or support elements 50 by U-bolts 33 and having a channel-shaped vertical main support member 35. A vertical slide channel 37 is vertically adjustably anchored to the support member 35 on the side thereof toward the antenna reflector 12 by means of bolts 39 which pass through vertical slots (not shown) in the slide channel 37.

Pivotally connected to the top of the slide channel 37 is a shelf member 41 which is braced by an adjustable support strut 43. The strut 43 is pivotally attached at one end to the shelf member 41 by a bolt 51 and at its other end has a slot 55 which slides on a bolt 57 passing through side walls of the vertical slide channel 37.

The shelf member 41 is pivotally attached to the upper end of the vertical slide channel 37 by a bolt 59 which passes through the side walls of the vertical slide channel 37.

In order to reconfigure the typical Ku-band bracket assembly 25 to facilitate the multiband feedhorn mount assembly according to the present invention, the vertical slide channel 37 in the standard Ku-band bracket assembly 25 is removed and reattached on the back side of the main support member 35 to become the geometry shown in FIGS. 2–5. It will be noted that the slide member 37 is now reversed, and in so doing the strut 43 faces rearwardly.

The shelf member 41 is removed form the vertical slide member 37 and strut 43 is reattached in the same orientation as in FIG. 1A, but with the forward holes which in FIG. 1A received bolt 51 now serving to pivot the shelf member 41 on the vertical slide member (labeled 56 in FIGS. 2–5). The rear holes in shelf member 41, which in FIG. 1A served to pivot the shelf member 41 on the vertical slide channel 37, now receive a bolt (64 in FIGS. 2–5) connecting the shelf member to the strut (60 in FIGS. 2–5). By reversing the relative functions of the forward and rear holes in the shelf member 41 (58 in FIGS. 2–5), the standard shelf member is moved away from the reflector 12 to a location which can more easily accommodate the preferably centered adapter bracket of a larger (e.g., C-band) feedhorn.

Figure 3A:
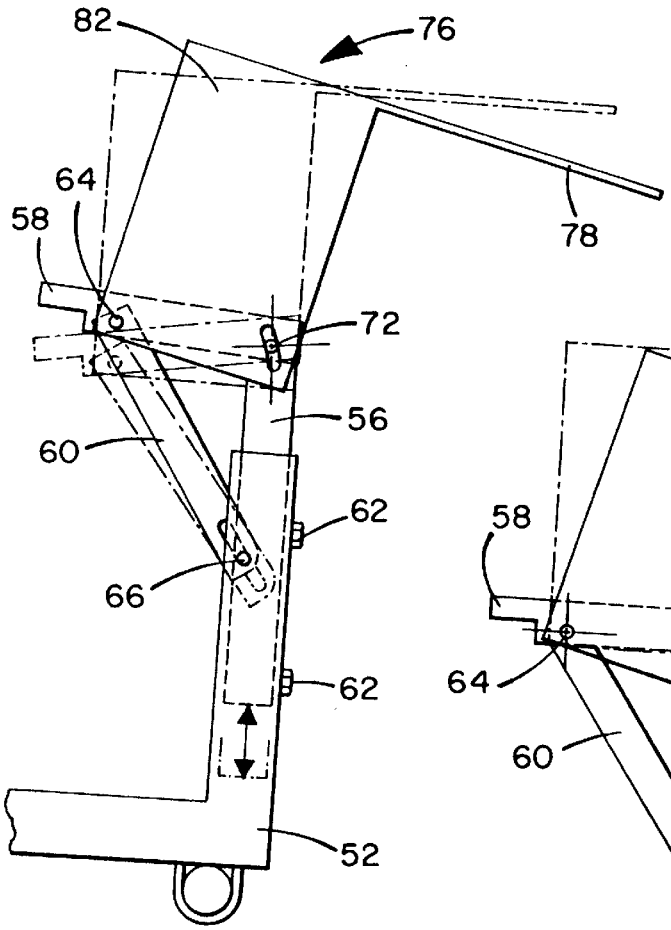
FIGS. 3A and 3B are views similar to FIG. 2, but simplified to illustrate the adjustments which may be made in the feedhorn mount assembly of the present invention.

FIG. 3A shows the various adjustments possible of the first mounting bracket 48. The vertical slide channel 56 may be vertically adjusted by loosening bolts 62, repositioning the vertical slide channel 56, and retightening the bolts 62.

The shelf member 58 may be adjusted in its angular position to alter the elevation of the C-band feedhorn 26 by loosening bolts 64, 66, and 72, setting the desired position of the shelf member 58, and then retightening bolts 64, 66, and 72.

In accordance with an aspect of the present invention, the multiband feedhorn mount assembly according to the present invention includes a second mounting or adapter bracket 76 which adjustably supports the Ku-band feedhorn 30 on the first mounting bracket 48. Specifically, the adapter bracket 76 has an inverted channel shape with a base plate 78 and a pair of parallel plate-like legs 80, 82 extending orthogonally from the base plate 78. The legs 80, 82 are adapted to be pivotally attached to the shelf member 58 of the first mounting bracket 48 by means of the bolt 64 at the rear of shelf member 58 which passes through openings 85, 87 in the legs 80, 86. The bolt 64 defines a pivot axis 100 for the bracket 76. To permit the adapter bracket 76 to be adjusted in angular elevation, the mounting bracket legs 80, 82 are provided with arcuate cut-outs 84, 86.

Figure 3B:
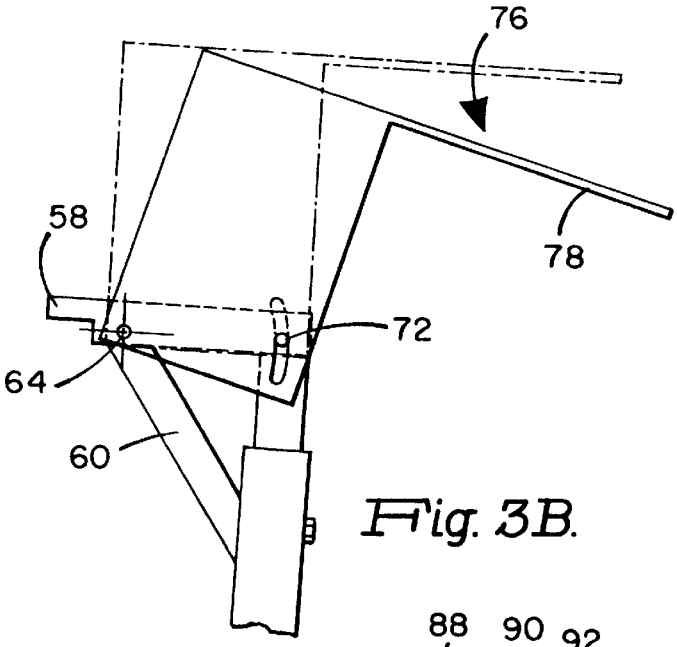
Figure 4:
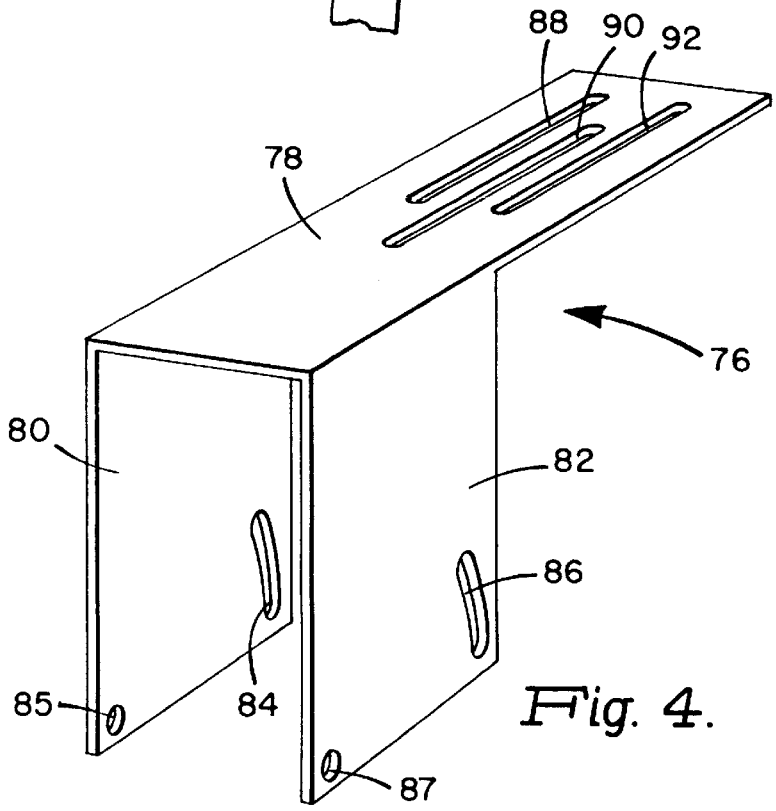
FIG. 4 is a view of a novel bracket which may comprise a component of the present invention.
Figure 5:
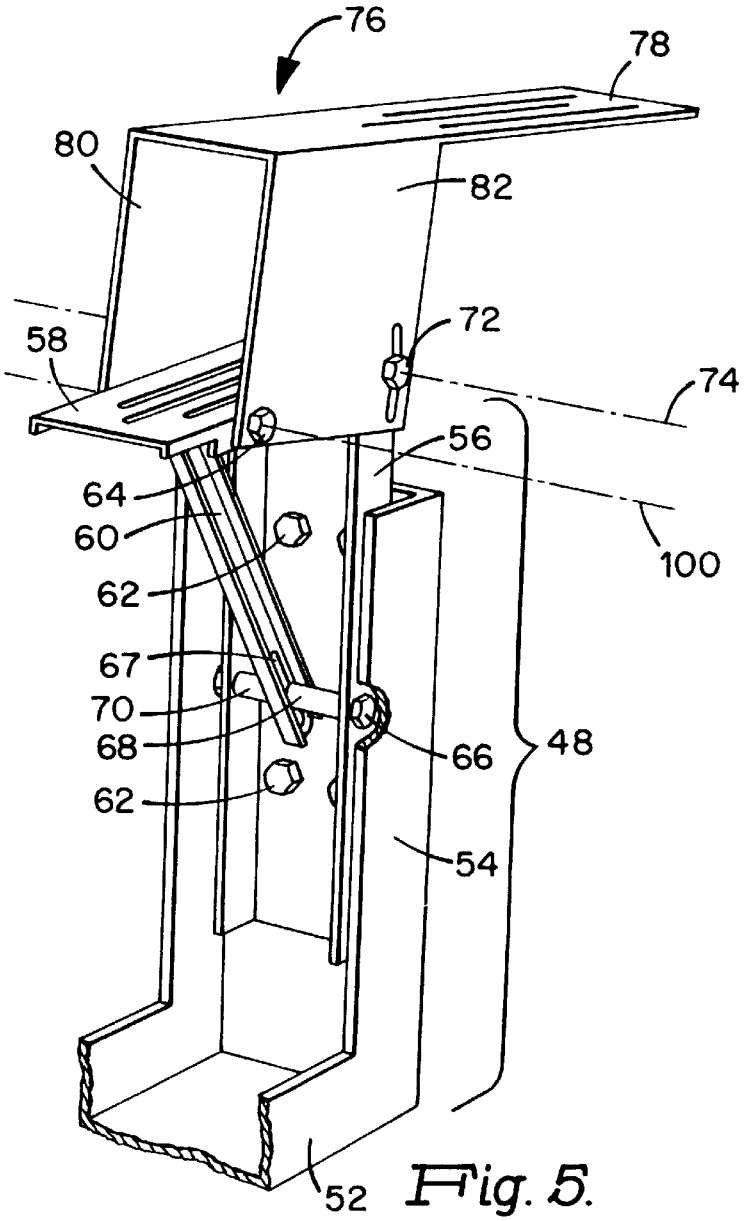
FIG. 5 is a perspective view of a feedhorn mount assembly according to the present invention.

As shown in FIG. 3B, the adapter bracket 76 may be adjusted in angular elevation by loosening the bolts 64 and 72, setting the mounting bracket 76 to the desired elevational attitude, and then retightening the bolts 64 and 72.

To permit the feedhorn carried by the mounting bracket 76 (here shown as the Ku-band feedhorn 30), to be positionally adjusted toward and away from the antenna reflector 12, a plurality of slots 88, 90, 92 are formed in the base plate 78 of the mounting bracket 76. Adjustable fasteners 94, 96 comprising part of a carriage 98 for the Ku-band feedhorn 30, pass through the slots 88, 90, 92, permitting the Ku-band feedhorn 30 to be translated (relative to reflector 12) forward and back to a desired position on the bracket 76. At the desired position, the fasteners 94, 96 are tightened to lock the Ku-band feedhorn 30 in the desired position on the bracket 76.

In a situation wherein the co-located signals are being transmitted from so-called co-located satellites (separated, but closely spaced longitudinally), for optimum reception by the two feedhorns 26, 30, the feedhorns are angularly displaced or canted slightly in the longitudinal (horizontal) direction so as to point at slightly displaced points along the center line 16 of the reflector 12.

Figure 6:
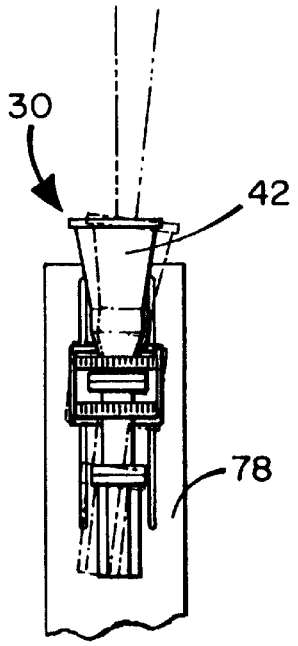
FIG. 6 is a partial plan view of the FIGS. 2–5 assembly.

As shown in FIG. 6, in the illustrated embodiment the Ku-band feedhorn 30 is canted very slightly with respect to the C-band feedhorn 26.

In accordance with an aspect of the present invention, means are provided for accomplishing the described canting of one feedhorn relative to the other. In the illustrated preferred embodiment, the slots 88, 90, 92 are made somewhat wider than the fasteners 94, 96 which pass through them in order that the Ku-band feedhorn carriage 98 may be canted slightly before being secured to the base plate 78. As described, the canting is such that each of the feedhorns point at the optimum longitudinal orientation relative to the reflector 12.

As discussed, the second mounting bracket 76 pivots on the shelf member 58 on bolt 64 which defines a rear pivot axis 100 such that the second mounting bracket 76 may be adjusted in elevation independently of the first mounting bracket 48 (FIG. 3B).

The first and second mounting brackets 48, 76 form an articulated linkage wherein the shelf member 58 which supports the C-band feedhorn 26 is pivotally mounted to rotate about horizontal pivot axis 74. The second mounting bracket 76 is pivotally mounted on the shelf member 58 to rotate about pivot axis 100 spaced more distant from the antenna reflector than the pivot axis 74.

It is thus seen that in accordance with an aspect of the present invention, the adapter bracket 76 mounts a second feedhorn (Ku-band, e.g.) 30 in a "piggyback" arrangement above the first feedhorn 26 secured to the modified standard bracket assembly 48. In a preferred embodiment, the standard bracket assembly 48, by means of the adapter bracket 76, has been reconfigured to provide a first support location located relatively away from the antenna reflector 12 for receiving the larger (C-band, e.g.) feedhorn 26 having an extended collector 32, and a second support location relatively closer to the focal point for receiving the smaller (Ku-band, e.g.) feedhorn 30. As a result, the input apertures of the respective feedhorns 26, 30 are positioned at substantially the same distance from the reflector and in the same zone of focused co-located satellite signal energy formed by the antenna reflector. By the present multiband feedhorn mount arrangement, both feedhorns are flexibly adjustable in both vertical and longitudinal angles to maximize respective signal reception.

As discussed above, signals transmitted by a particular satellite are collected by the reflector 12 and focused to a narrow zone of RF energy at the location of the feedhorn. The satellite transmissions in the C-band form a zone of focused RF energy which is somewhat larger than that formed by the higher frequency transmissions from a satellite broadcasting in the Ku-band. The zone of RF energy formed with the C-band signal is in the same place as the Ku-band RF energy if both transmissions are from the same point in space, as is the case (disallowing for the slight separation of the transmitting antennas) where a hybrid satellite is transmitting both C-band and Ku-band signals. In the instance where the co-located transmissions are radiating from closely adjacent but spaced satellites, the zones of RF energy formed in the region of the feedhorns by the antenna reflector are slightly displaced, but overlapped.

In accordance with an aspect of the present invention, it is desired to obtain as much of the overlapped multiband RF energy zones as is possible.

Two possible methods for installing the multiband feedhorn mount assembly in accordance with the present invention will now be described. In accordance with a first installation method, the mount assembly is adjusted such that the input apertures of the C-band feedhorn 26 and the Ku-band feedhorn 30 are contiguous and located at approximately the same distance from antenna reflector 12. The height of the combined feedhorns is adjusted such that the RF energy entering the input apertures of the feedhorns is such as to optimize the desired relative or overall performance of the feedhorns. In most applications, it will be desired to have the performance of both feedhorns maximized equally, or nearly so, however in certain applications it may be desirable to compromise the performance of one feedhorn relative to the other.

The angular elevation of the mount assembly is adjusted relative to the antenna reflector 12 to peak the performance of the feedhorns. Finally, one or more of the above steps is repeated as necessary to achieve the maximum desired relative or overall performance of the feedhorns.

The methods steps recited are not necessarily performed in the order given.

In accordance with a second method of installing the multiband feedhorn mount assembly according to the invention, the following steps are performed, not necessarily in the order described. First the feedhorns 26, 30 together are adjusted in elevation such that the input apertures thereof receive the maximum RF energy from the satellite of interest. The C-band feedhorn 26 is adjusted in orientation relative to the reflector 12 to achieve a desired maximum input signal strength. The Ku-band feedhorn 30 is then boresighted on the unmarked region or "sweet spot" 106 on the reflector at which the C-band feedhorn 26 is pointed. The orientations of the C-band and Ku-band feedhorns 26, 30 and their vertical elevation are then fine tuned for maximum desired relative or overall performance of the feedhorns.

In the practice of the last-described method, the C-band feedhorn 26 and the Ku-band feedhorn 30 will be sighted along sight lines 102, 104 at a common "sweet spot" 106 on the center line 16 of the reflector 12.

Numerous variations of the foregoing invention are possible. It should be understood, therefore, that a wide range of other changes and modifications can be made to the preferred embodiment. For example, structures for the second mounting bracket 76 other than as illustrated and described maybe employed to implement the principles of the present invention. The invention is applicable for use with feedhorns adapted to receive frequencies other than Ku-band and C-band frequencies. Installation methods other than as described are also within the spirit and scope of the present invention. It is therefore intended that the foregoing detailed description be regarded as illustrative rather than limiting, and that it be understood that it is the foregoing claims, including all equivalents, which are intended to define the scope of the invention.

What is claimed is:

1. A multiband feedhorn mount assembly for co-locating first and second feedhorns on a ground satellite receiving antenna having a reflector and a feedhorn support, comprising:

a first mounting bracket adapted to be secured to said feedhorn support for adjustably supporting said first feedhorn; and a second mounting bracket for adjustably supporting said second feedhorn, said second mounting bracket being pivotally attached to said first mounting bracket such that the angular elevation of said second bracket can be independently adjusted relative to said first bracket, and when said first and second feedhorns are respectively attached to said first and second mounting brackets, said first and second feedhorns may be individually oriented relative to said reflector.

2. The assembly defined by claim 1 wherein said first and second feedhorns, when operatively installed on said mount assembly, point at a common region on said reflector.

3. The assembly defined by claim 1 wherein each of said first and second feedhorns has an input aperture, and, when operative, the input apertures of said first and second feedhorns are located approximately equidistant from said reflector.

4. The assembly defined by claim 1 wherein: (1) said first mounting bracket includes (a) a base, (b) means for anchoring said base to said feedhorn support, and (c) a shelf coupled to said base for supporting said first feedhorn; (2) said shelf is pivotally mounted to rotate about a first axis; and, (3) said second bracket is pivotally mounted on said shelf to rotate about a second axis, said second axis being spaced farther from said antenna reflector than said first axis.

5. The apparatus defined by claim 4 wherein said second mounting bracket has an inverted channel shape, and wherein each of said legs has a plate-like structure extending in parallel from said base plate for attachment on opposite sides of said first mounting bracket.

6. The assembly defined by claim 1 wherein said second mounting bracket has a base plate and a pair of legs extending from said base plate, said legs being pivotally attached to said first mounting bracket.

7. The assembly defined by claim 6 wherein said base plate has a series of parallel slots and wherein said second feedhorn is carried by a carriage having fasteners passing through said slots which provide for translation of said second feedhorn relative to said second mounting bracket.

8. The apparatus defined by claim 7 wherein said fasteners are narrower than said slots such that said second feedhorn may be secured to said base plate canted with respect to said base plate to improve signal reception by said feedhorns of signals from different longitudinally spaced satellites.

9. The assembly defined by claim 1 wherein said first mounting bracket is adapted to support a C-band feedhorn, and wherein said second mounting bracket is adapted to support a Ku-band feedhorn.

10. For use with a ground satellite receiving antenna for receiving co-located transmissions in a plurality of frequency bands from one or more satellites and including a reflector and an antenna bridge, a multiband feedhorn mount assembly for co-locating first and second feedhorns on said satellite receiving antenna, said multiband feedhorn mount assembly comprising:

a first mounting bracket secured to said antenna bridge and adjustably supporting a first feedhorn; and a second mounting bracket supporting a second feedhorn and including means for adjustably attaching said second mounting bracket to said first mounting bracket such that said second feedhorn may be individually oriented relative to said first feedhorn and to said reflector, said second mounting bracket being pivotally attached to said first mounting bracket to provide for independent angular elevation of said second bracket relative to said first bracket.

11. The assembly defined by claim 10 wherein said first and second feedhorns, when operatively installed on said mount assembly, point at a common region on said reflector.

12. The assembly defined by claim 10 wherein each of said first and second feedhorns has an input aperture and, when operative, the input apertures of said first and second feedhorns are approximately equidistant from said reflector.

13. The assembly defined by claim 10 wherein: (1) said first mounting bracket includes (a) a base, (b) means for anchoring said base to said antenna bridge, and (c) a support structure for supporting said first feedhorn; (2) said support structure is pivotally mounted to rotate about a first horizontal axis; and, (3) said second bracket is pivotally mounted on said support structure to rotate about a second horizontal axis, said second axis being spaced farther from said reflector than said first axis.

14. The assembly defined by claim 13 wherein said second mounting bracket has an inverted channel shape with a base plate and a pair of legs extending orthogonally from said base plate, said legs being mounted to rotate on said first mounting bracket about said second axis.

15. The assembly defined by claim 6 wherein said second mounting bracket has an inverted channel shape with a base plate and a pair of legs extending orthogonally from said base plate, said legs being pivotally attached to said first mounting bracket.

16. The assembly defined by claim 15 wherein said base plate has a series of parallel slots, and wherein said second feedhorn is carried by carriage means having fasteners passing through said slots which provide for translation of said second feedhorn relative to said second mounting bracket.

17. The apparatus defined by claim 16 wherein said fasteners are narrower than said slots such that said second feedhorn may be secured to said base plate canted with respect to said base plate to improve signal reception by said feedhorns of signals from different longitudinally spaced satellites.

18. The assembly defined by claim 10 wherein said first mounting bracket is adapted to support a C-band feedhorn, and wherein said second mounting bracket is adapted to support a Ku-band feedhorn.

19. For use in multiband feedhorn mount assembly for co-locating first and second feedhorns on a ground satellite receiving antenna, and particularly for piggybacking a second feedhorn upon a first feedhorn mounting bracket assembly, an adapter bracket comprising: a base plate for adjustably supporting said second feedhorn, a pair of legs extending from said base plate, and means for pivotally attaching said legs of said adapter bracket to the first feedhorn mounting bracket assembly.

20. The apparatus defined by claim 19 wherein said adapter bracket has an inverted channel shape, and wherein each of said legs has a plate-like structure extending in parallel from said base plate for attachment on opposite sides of said first feedhorn mounting bracket assembly.

* * * * *